US008495987B2

(12) United States Patent
Lucas et al.

(10) Patent No.: US 8,495,987 B2
(45) Date of Patent: Jul. 30, 2013

(54) SINGLE PISTON PUMP WITH DUAL RETURN SPRINGS

(75) Inventors: Robert Lucas, Ellington, CT (US); Ilija Djordjevic, East Granby, CT (US)

(73) Assignee: Stanadyne Corporation, Windsor, CT (US)

( * ) Notice: Subject to any disclaimer, the term of this patent is extended or adjusted under 35 U.S.C. 154(b) by 567 days.

(21) Appl. No.: 12/802,617

(22) Filed: Jun. 10, 2010

(65) Prior Publication Data

US 2011/0303195 A1 Dec. 15, 2011

(51) Int. Cl.
*F02M 37/04* (2006.01)

(52) U.S. Cl.
USPC ..... 123/495

(58) Field of Classification Search
USPC ..... 123/495, 509; 417/470–471
See application file for complete search history.

(56) References Cited

U.S. PATENT DOCUMENTS

| | | | | |
|---|---|---|---|---|
| 2,830,566 | A | 11/1954 | Allen | 123/90 |
| 6,116,220 | A * | 9/2000 | Geiger et al. | 123/502 |
| 6,439,204 | B1 | 8/2002 | Duquette | 123/506 |
| 6,619,186 | B2 | 9/2003 | Duquette et al. | 92/60.5 |
| 7,509,947 | B2 | 3/2009 | Tansug et al. | 123/500 |
| 2008/0213112 | A1 * | 9/2008 | Lucas | 417/471 |

FOREIGN PATENT DOCUMENTS

| | | |
|---|---|---|
| GB | 392491 | 5/1933 |
| GB | 537772 | 7/1941 |
| GB | 665623 | 1/1952 |

* cited by examiner

*Primary Examiner* — Hai Huynh
(74) *Attorney, Agent, or Firm* — Alix, Yale & Ristas, LLP

(57) ABSTRACT

Pump piston seizures caused by excessive side loads produced by the uneven loading of a large piston return spring are prevented by separating the tappet return function from the piston return function, thereby minimizing the spring force acting on the piston. Preferably, a stronger, heavier load outer spring is mounted between the pump body and the tappet, such that it imparts no load and therefore no side loads to the pumping piston. A weaker, lighter load inner spring imparts less side load to the pumping piston than a conventional piston return spring, because the inner spring need not carry any tappet load. During both the pumping and charging strokes of the piston, the piston return spring can assist the tappet return spring, but the tappet return spring does not assist the piston return spring.

17 Claims, 1 Drawing Sheet

SINGLE PISTON PUMP WITH DUAL RETURN SPRINGS

BACKGROUND

The present invention relates to radial piston fuel supply pumps, and particularly to single piston pumps for pressurizing common rail fuel injection systems.

Single piston, cam driven high pressure pumps have become a common solution for generating high pressure fuel in common rail, direct injection, gasoline engines. These pumps are typically driven by a tappet mounted adjacent to a valve cam for cyclically pushing on the actuated end of the pumping piston. In the case of overhead cam engine applications, a short, light weight tappet is used and the overall reciprocating mass of the pump system is manageable with a single return spring mounted at the exterior of the fuel pump. This spring directly returns the piston and the piston simultaneously returns the tappet. However, when adapting direct injection technology to a conventional push-rod type V-6 or V-8 engine with a single cam shaft, it becomes evident that longer, heavier tappets must be managed. In this case the cam shaft is centrally located in the engine, and the desired position of the pump is atop the engine, to accommodate fuel connection access. The added reach results in a longer tappet arrangement and increased reciprocating mass. This significant increase in mass requires return spring loads that can be more than two times the typical loads in overhead cam engines.

The conventional piston return spring is located between the pump body and a spring seat mounted on the actuated end of the piston. Such return springs provide the dual functions of returning the plunger and returning the tappet. Increasing the size of a single return spring presents two problems. First, trying to package a longer, more powerful spring while maintaining the same extension of the piston outside the pump body, becomes difficult and very costly. Second, a more powerful spring can impart significant unwanted side loads on the pumping piston, which can produce piston seizures. The uneven loads are caused by normal spring end squareness tolerances, and eccentric loading (offset from centerline) caused by spring geometry variations.

SUMMARY OF THE INVENTION

The primary purpose of the present invention is to eliminate pump piston seizures caused by excessive side loads produced by the uneven loading of a large piston return spring.

This is achieved by separating the tappet return function from the piston return function, thereby minimizing the spring force acting on the piston. Separate and distinct biasing means perform the respective functions.

Preferably, a stronger, heavier load outer spring is mounted between the pump body and the tappet, such that it imparts no load and therefore no side loads to the pumping piston. A weaker, lighter load inner spring imparts less side load to the pumping piston than a conventional piston return spring, because the inner spring need not carry any tappet load. During both the pumping and charging strokes of the piston, the piston return spring can assist the tappet return spring, but the tappet return spring does not assist the piston return spring.

In one aspect, there is disclosed herein a high pressure single piston fuel pump having a body, a pumping chamber within the body, a piston with one end in the pumping chamber and another end outside the body, and which is reciprocable between a retracting motion away from the pumping chamber and a pumping motion toward the pumping chamber. A tappet bears on the other end of the piston to impart the pumping motion. A piston return spring seats at the piston and biases the piston toward the tappet, and a distinct tappet return spring seats at the tappet.

Preferably, the piston reciprocates in a sleeve held in the body by a retainer and each of the piston return spring and the tappet return spring seats against the retainer.

From another aspect, the improvement comprises that the piston return spring is connected to the piston and not the tappet and a distinct tappet return spring acts on the tappet and not on the piston.

Preferably, each spring is an elongated coil spring, the piston return spring is coaxially situated within the tappet return spring, and the tappet return spring has a higher spring rate than the piston return spring.

Splitting up the required total load to reciprocate the piston plus inner spring seat plus tappet into two separate springs, reduces spring induced piston side load by eliminating all piston side load caused by the outer spring. Because the outer spring has a higher load and stiffness (required to return the high tappet mass) than the inner spring, spring induced piston side load is minimized.

The outer spring (tappet return) is preferably affixed to the pump with an interference fit onto the outer spring retainer to allow handling and assembly into the engine. The advantage is that the engine manufacturer need not handle and assemble a loose outer spring.

DESCRIPTION OF THE PREFERRED EMBODIMENT

Figure 2:
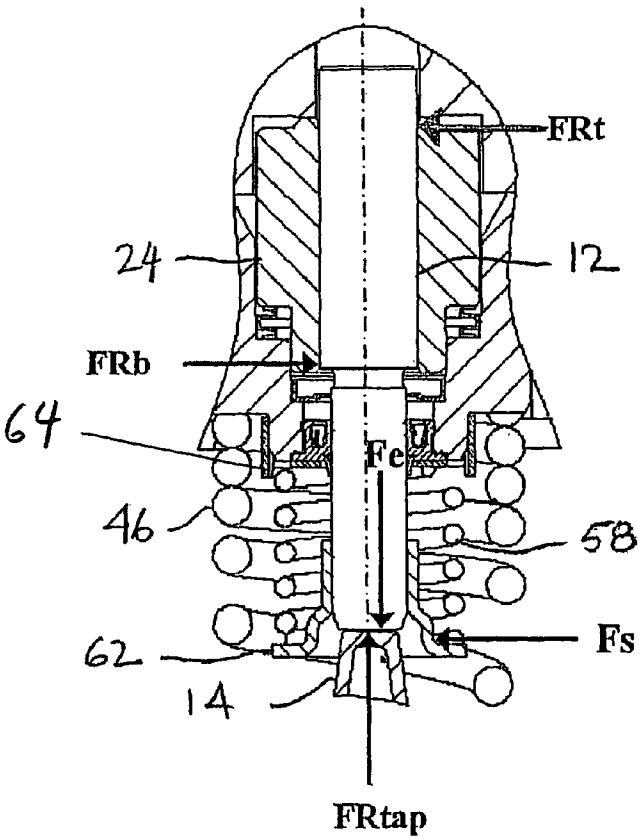
FIG. 2 is a free body diagram showing the side load forces that act on the pumping piston in the embodiment of FIG. 1.
Figure 1:
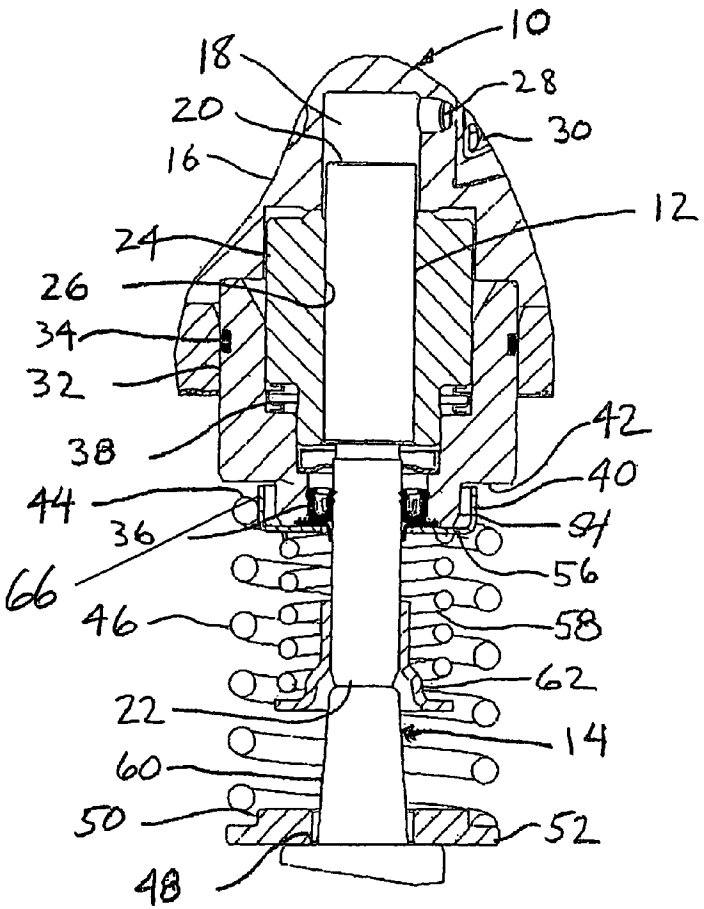
FIG. 1 is a cross-sectional view of one embodiment of the invention.

FIGS. 1 and 2 show the portion of a single piston high pressure pump 10 where the pumping piston 12 is actuated by a tappet 14 according to an embodiment of the present invention. The pump has a body 16, a pumping chamber 18 within the body, a piston with one (inner) end 20 in the pumping chamber and another (outer) end 22 outside the body. A piston sleeve 24 is secured to the body and has a bore 26 in which the piston reciprocates between a retracting motion during which fuel is delivered to the pumping chamber and a pumping motion during which the piston pressurizes fuel in the pumping chamber. The pressurized fuel is discharged through a port 28 and discharge check valve 30 into a high pressure line for pressurizing the common rail.

The tappet 14 bears on the outer actuated end 22 of the piston to impart the pumping motion. The tappet is forced upward by an engine camshaft as is well known but not shown. The tappet, being in contact with the pumping piston, in turn forces the piston upward to compress fluid in the pumping chamber 20. The piston preferably fits within the bore 26 of the piston sleeve with a controlled radial clearance. The piston sleeve is positioned and guided with a sleeve retainer 32 fixed to the body. The preferred configuration of piston 12, sleeve 24, retainer 32, seals 34, 36, and load ring 38 is described in U.S. Publication 2008/0213112, "Load Ring Mounting of Pumping Plunger", the entire disclosure of which is hereby incorporated by reference. The present invention is not, however, dependent on how the piston is mounted in the body.

An outer spring retainer 40 is preferably positioned onto the sleeve retainer 32 by an interference fit. The sleeve retainer 32 has an exterior end facing the tappet, defining an outer annular shoulder 42 where one end 44 of the tappet return spring 46 is seated. The tappet has a shoulder 48 where the other end 50 of the tappet return spring is seated, either directly or on a separate outer spring seat 52 resting on the shoulder of the tappet.

Preferably, the exterior end face of the sleeve retainer 32 has an annular neck 54 through which the piston extends, and the spring retainer is supported by the neck. An inner rim portion 64 and shoulder 56 provide a guide and seat for the piston return spring 58 and an outer rim portion 66 and shoulder 42 provide a guide and seat for the outer spring 46, and thereby maintain a minimum separation between the springs. Thus each of the piston return spring 58 and the tappet return spring 46 seats directly or indirectly against the sleeve retainer. The spring seat is preferably made from a stamping process in order to easily fabricate the interrupted rim portions 64, 66 and press-fit diameter for retention on the annular neck 54. The rim portion 66 can be interference fit with the outer spring 46 to retain the spring during pump shipment. The spring seat 40 also forms a shoulder that retains seal 36 within sleeve retainer 32.

Each of the piston return spring 58 and tappet return spring 46 is an elongated coil spring. The tappet 14 has a head 60 bearing on the outer end 22 of the piston projecting from the shoulder 48 on which the tappet return spring seats directly or indirectly. The piston return spring is situated coaxially within the tappet return spring. The outer spring 46 forces the mass of the tappet 14 downward during the pump charging cycle, but applies no load through the piston 12. The inner spring retainer 58 is affixed to the piston 12 preferably by interference fit. The inner spring 62 forces the mass of the piston and inner spring retainer downward during the pump charging cycle, thereby maintaining intimate contact between the piston 12 and tappet 14.

FIG. 2 shows a free body diagram depicting the pumping piston side loads imparted by the inner spring 58. Fs is the load caused by spring centerline out of squareness, which occurs when the end squareness offset exceeds the clearances between the guided end coils. Fe is the eccentric load caused by spring variations such as end face parallelism, coil geometry, centerline squareness, and end face contact surface (360 degree contact is not possible). FRtap is the reaction load imparted to the tappet 14. FRb is the reaction load imparted to the bottom of the piston sleeve 24. FRt is the reaction load imparted onto the top of the piston sleeve. The outer spring 46 imparts no side loads to the pumping piston 12 because it never contacts it or the inner spring seat 62.

The invention claimed is:

1. In a cam-driven high pressure single piston fuel pump having a body, a pumping chamber within the body, a piston with one end in the pumping chamber and another end outside the body, a piston sleeve secured to the body and having a bore in which the piston reciprocates between a retracting motion during which fuel is delivered to the pumping chamber and a pumping motion during which the piston pressurizes fuel in the pumping chamber, a non-hydraulic tappet bearing directly on the cam and directly on the other end of the piston to impart said pumping motion, and a piston return spring biasing the piston toward the tappet, wherein the improvement comprises that the piston return spring seats at the piston and a distinct tappet return spring seats at the tappet such that the tappet spring imparts no load on the piston.

2. The pump of claim 1, wherein a sleeve retainer holds the piston sleeve within the body and each of the piston return spring and the tappet return spring seats directly or indirectly against the sleeve retainer.

3. The pump of claim 2, wherein each of the piston return spring and tappet return spring is an elongated coil spring and the piston return spring is situated coaxially within the tappet return spring.

4. The pump of claim 2, wherein the tappet has a head bearing on the other end of the piston and a shoulder on which the tappet return spring seats.

5. The pump of claim 1, wherein each of the piston return spring and tappet return spring is an elongated coil spring.

6. The pump of claim 5, wherein the tappet has a head bearing on the other end of the piston and a shoulder on which the tappet return spring seats.

7. The pump of claim 1, wherein the tappet has a head bearing on the other end of the piston and a shoulder on which the tappet return spring seats.

8. The pump of claim 1, wherein a sleeve retainer holds the piston sleeve within the body and has an exterior end facing the tappet, said exterior end having an outer annular shoulder where one end of the tappet return spring is seated and said tappet having a shoulder where another end of the tappet return spring is seated.

9. The pump of claim 8, wherein the exterior end face of the sleeve retainer has an inner annular neck through which the piston extends, and a spring retainer is supported by said neck, having an inner, ring portion providing a seat for the piston return spring and an outer rim portion at said shoulder, for maintaining a minimum separation between the springs.

10. In a high pressure single piston fuel pump having a body, a pumping chamber within the body, a piston with one end in the pumping chamber and another end outside the body, a piston sleeve secured to the body and having a bore in which the piston reciprocates between a retracting motion during which fuel is delivered to the pumping chamber and a pumping motion during which the piston pressurizes fuel in the pumping chamber, a tappet bearing on the other end of the piston to impart said pumping motion, and a piston return spring biasing the piston toward the tappet, wherein the improvement comprises that the piston return spring is connected to the piston and not the tappet and a distinct tappet return spring is provided that acts on the tappet and not on the piston.

11. The pump of claim 10, wherein each spring is an elongated coil spring, the piston return spring is coaxially situated within the tappet return spring, and the tappet return spring has a higher spring rate than the piston return spring.

12. The pump of claim 11, wherein a sleeve retainer holds the piston sleeve within the body and each of the piston return spring and the tappet return spring seats directly or indirectly against the sleeve retainer.

13. The pump of claim 10, wherein a sleeve retainer holds the piston sleeve within the body and has an exterior end facing the tappet, said exterior end having an outer annular shoulder where one end of the tappet return spring is seated and said tappet having a shoulder where another end of the tappet return spring is seated.

14. The pump of claim 13, wherein the exterior end face of the sleeve retainer has an inner annular neck through which the piston extends, and a spring retainer is supported by said neck, having an inner, ring portion providing a seat for the piston return spring and an outer rim portion at said shoulder, for maintaining a minimum separation between the springs.

15. In a high pressure single piston fuel pump having a body, a pumping chamber within the body, a piston with one end in the pumping chamber and another end outside the body, which piston reciprocates between a retracting motion away from the pumping chamber and a pumping motion toward the pumping chamber, and a tappet bearing on the other end of the piston and cyclically driven toward the pumping chamber to impart said pumping motion on the piston, and means for retracting the piston and tappet away from the pumping chamber during said retraction motion, wherein the improvement comprises that the means for retracting the tappet are physically and operationally separate and distinct from the means for retracting the piston.

16. The pump of claim 15, wherein the means for retracting the piston is a coil return spring connected to the piston and not the tappet and the means for retracting the tappet is a separate and distinct coil return spring that acts on the tappet and not on the piston.

17. The pump of claim 16, wherein the tappet return spring has a higher spring rate than the piston return spring.

* * * * *